US008455168B2

(12) United States Patent
Kiyono et al.

(10) Patent No.: US 8,455,168 B2
(45) Date of Patent: Jun. 4, 2013

(54) ELECTROPHOTOGRAPHIC DEVELOPER, DEVELOPER CARTRIDGE, PROCESS CARTRIDGE, AND IMAGE FORMING APPARATUS

(75) Inventors: Fusako Kiyono, Kanagawa (JP); Sakon Takahashi, Kanagawa (JP); Toshiaki Hasegawa, Kanagawa (JP); Takeshi Shoji, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 319 days.

(21) Appl. No.: 12/862,028

(22) Filed: Aug. 24, 2010

(65) Prior Publication Data

US 2011/0236813 A1 Sep. 29, 2011

(30) Foreign Application Priority Data

Mar. 26, 2010 (JP) ..... 2010-073498

(51) Int. Cl.
*G03G 9/113* (2006.01)

(52) U.S. Cl.
USPC ..... 430/111.35; 430/108.3; 430/111.4

(58) Field of Classification Search
USPC ..... 430/108.3, 111.35, 111.4
See application file for complete search history.

(56) References Cited

FOREIGN PATENT DOCUMENTS

JP A 3-100661 4/1991

OTHER PUBLICATIONS

"Basic Theory of Adhesionm" Chapter 5: Solubility Parameter, SP, Mar. 21, 1993, pp. 89-103. (with English-language translation).

*Primary Examiner* — Peter Vajda
(74) *Attorney, Agent, or Firm* — Oliff & Berridge, PLC

(57) ABSTRACT

An electrophotographic developer is provided which includes: a toner that includes toner base particles and an external additive attached to a surface of the toner base particles and has an amount of Al on the surface of the toner base particles of from about 0.002 to about 0.02 atm %; and a carrier that includes magnetic particles and a coating resin layer that coats the magnetic particles, the coating resin layer including particles with a volume-average particle diameter of from about 80 to about 800 nm, such as organic particles or inorganic particles having an organic layer on a surface of the inorganic particles, the carrier satisfying any one of the following formulas, where SP1, SP2 and SP3 represent a solubility parameter of resin of the coating resin layer, the organic particles, and the organic layer respectively:

$$\text{about } 10 > |SP1 - SP2| > \text{about } 4 \quad (1); \text{ and}$$

$$\text{about } 10 > |SP1 - SP3| > \text{about } 4 \quad (2).$$

17 Claims, 2 Drawing Sheets

ELECTROPHOTOGRAPHIC DEVELOPER, DEVELOPER CARTRIDGE, PROCESS CARTRIDGE, AND IMAGE FORMING APPARATUS

CROSS-REFERENCE

This application is based on and claims priority under 35 USC 119 from Japanese Patent Application No. 2010-073498 filed on Mar. 26, 2010.

BACKGROUND

1. Technical Field

The present invention relates to an electrophotographic developer, a developer cartridge, a process cartridge, and an image forming apparatus.

2. Related Art

In recent years, copy machines and printers have been moving toward a decrease in size and an increase in speed. In addition, an increase in the resolution of a color image using a small-diameter toner or an increase in image density has been accomplished.

SUMMARY

According to an aspect of the invention, there is provided an electrophotographic developer including:

a toner that includes toner base particles and an external additive attached to a surface of the toner base particles, an amount of Al on the surface of the toner base particles being from about 0.002 atm % to about 0.02 atm %; and a carrier that includes magnetic particles and a coating resin layer that coats the magnetic particles, the coating resin layer including organic particles with a volume-average particle diameter of from about 80 nm to about 800 nm or inorganic particles having an organic layer on a surface of the inorganic particles with a volume-average particle diameter of from about 80 nm to about 800 nm, the carrier satisfying one of the following formulas, SP1 representing a solubility parameter of a resin of the coating resin layer, SP2 representing a solubility parameter of the organic particles, and SP3 representing a solubility parameter of the organic layer:

$$\text{about } 10>|SP1-SP2|>\text{about } 4 \quad (1); \text{ and}$$

$$\text{about } 10>|SP1-SP3|>\text{about } 4 \quad (2).$$

BRIEF DESCRIPTION OF THE DRAWINGS

Exemplary Embodiments of the present invention will be described in detail based on the following figures, wherein.

DETAILED DESCRIPTION

Figure 1:
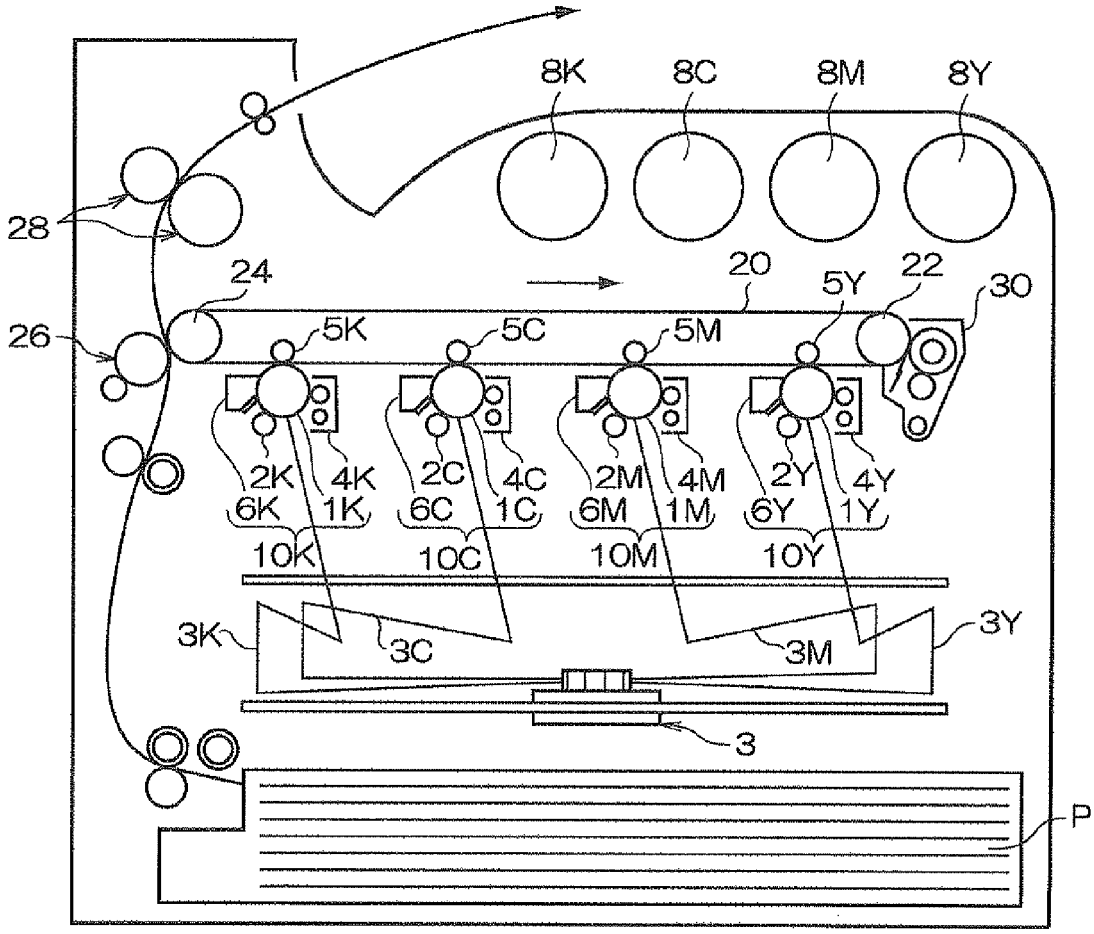
FIG. 1 is a diagram schematically illustrating the configuration of an image forming apparatus according to an exemplary embodiment of the present invention.

Hereinafter, exemplary embodiments of the invention will be described in detail.

Electrophotographic Developer

An electrophotographic developer (hereinafter, referred to as "developer") according to an exemplary embodiment of the invention includes: a toner that includes toner base particles and an external additive attached to the surface of the toner base particles and has an amount of Al on the surface of the toner base particles of from 0.002 atm % (or about 0.002 atm %) to 0.02 atm % (or about 0.02 atm %); and a carrier that includes magnetic particles and a coating resin layer for coating the magnetic particles, the coating resin layer including organic particles with a volume-average particle diameter of from 80 nm (or about 80 nm) to 800 nm (or about 800 nm) or inorganic particles having an organic layer on the surface with a volume-average particle diameter of from 80 nm (or about 80 nm) to 800 nm (or about 800 nm), the carrier satisfying one of the following Formulas, where SP1 represents a solubility parameter of resin of the coating resin layer, SP2 represents a solubility parameter of the organic particles, and SP3 represents a solubility parameter of the organic layer:

$$10>|SP1-SP2|>4 \text{ (or about } 10>|SP1-SP2|>\text{about } 4) \quad (1); \text{ and}$$

$$10>|SP1-SP3|>4 \text{ (or about } 10>|SP1-SP3|>\text{about } 4) \quad (2).$$

Electrophotographic apparatuses are progressing in terms of color. In general, color images have a large variation in image density, and a toner in a developing unit degrades with a continuous printout at a low image density. On the other hand, the diameter of toner particles is becoming smaller for the purpose of increasing reproducibility, but the amount of charged electricity of one toner particle decreases with the decrease in diameter. However, regarding an adhesive force between the toner and the photoreceptor, that is, the resultant force of an image force between the toner and the photoreceptor and an intermolecular force between the toner and the photoreceptor, since the intermolecular force increases with a decrease in image force, the ratio of the non-electrostatic adhesive force increases. Therefore, transferring an image by a transfer electric field becomes difficult in accordance with a decrease in diameter. A method of reducing a contact area of such a small-diameter toner using an external additive with a relatively-large particle diameter can be practically used.

However, when the toner degrades and the external additive is thus buried, the effect of the large-diameter external additive is not sufficiently exhibited. In recent high-speed apparatuses, a large stress may be applied to the developer and, particularly, a so-called process black (a black color obtained by combining three third colors of cyan (C), magenta (M), and yellow (Y)) at a high image density (Cin) does not easily acquire a transferable property after it is used at a low image density under high-temperature and high-humidity conditions for a long time. In an image of the process black at a high Cin after it is used at a low image density for a long time, a degraded toner and an initial toner added by a large amount to output a high image density coexist. Since there is a difference in adhesive force therebetween, the degraded toner is not transferred at the time of transferring the initial toner, but electric charges are injected into the initial toner at the time of transferring the degraded toner. Particularly, when a pile height (the thickness of the toner on a transfer medium) increases like the process black, the inter-toner adhesive force also acts in addition to the adhesive force between the photoreceptor and the toner, thereby easily causing the transfer unevenness.

On the other hand, when the developer according to this exemplary embodiment is used, particles are separated from the coating resin layer of the carrier and the particles are first supplied as an external additive (transfer assisting agent) to the degraded toner. Accordingly, even when the degraded toner and the initial toner are mixed to form a toner image, it is possible to suppress the transfer unevenness. That is, the coating resin of the carrier is abraded by the agitation with the toner or the like, but the abrasion is promoted when toners (the initial toner and the degraded toner) having different values of fluidity coexist. The particles dispersed in the coating resin layer can easily move to the surface of the degraded toner by the abrasion of the coating resin. The reason is presumed to be for the following two points.

(1) Since the coating resin and the surface treating agent of the dispersed organic particles or inorganic particles have a great difference in SP value, the affinity is poor and thus the particles can be easily separated.

(2) Since the ion cross-linkage is small (the amount of Al is small) in the surface of the toner according to the invention and the elasticity of the surface is low, particles can be attached to the surface.

Since the degraded toner to which the organic particles separated from the coating resin of the carrier or the surface-processed inorganic particles are attached becomes closer to the initial toner in terms of the difference in adhesive force, it is inferred that even a high pile height image is transferred without unevenness.

Toner

The toner included in the developer according to this exemplary embodiment includes toner base particles and an external additive attached to the surface of the toner base particles, and the amount of Al on the surface of the toner base particles is in the range of from 0.002 atm % (or about 0.002 atm %) to 0.02 atm % (or about 0.02 atm %).

When the amount of Al on the surface of the toner base particles is less than about 0.002 atm %, the burial of the external additive due to the stress of the developing unit is great and the thus the transfer maintenance is not guaranteed. When the amount of Al is greater than about 0.02 atm %, the surface of the toner base particles is excessively hard and thus the particles separated from the coating resin layer of the carrier do not actively move thereto.

The method of identifying the amount of Al on the surface of the toner base particles in this exemplary embodiment will be described in Examples.

The volume-average particle diameter of the toner base particles may be preferably in the range of from 3.5 μm (or about 3.5 μm) to 5.0 μm (or about 5.0 μm), and more preferably in the range of from 3.6 μm to 4.8 μm. When the volume-average particle diameter of the toner base particles is equal to or less than about 5.0 μm, it may be possible to obtain the image quality with a high resolution. On the other hand, when the volume-average particle diameter of the toner base particles is equal to or more than about 3.5 μm, it may be possible to suppress the deterioration in charging characteristic due to the deterioration in fluidity of the toner and the blushing in background or the toner overflow from the developing unit do not easily occur.

The volume-average particle diameter is measured with an aperture diameter of 50 μm using MULTISIZER II (made by Beckman Coulter Inc.). At this time, the measurement is performed after the toner is dispersed in an electrolyte solution (ISOTON solution) using ultrasonic waves for 30 seconds or more.

The amount of charged electricity per particle in the small-diameter toner decreases and it is thus difficult to perform a transfer operation, using the transfer electric field. Particularly, when the external additive attached to the toner base particles is buried, a great difference in adhesive force to the photoreceptor exists between the initial toner and the degraded toner, thereby easily causing the transfer unevenness. However, by using the developer according to this exemplary embodiment, the organic particles separated from the coating resin layer of the carrier or the inorganic particles having an organic layer on the surface thereof are preferentially attached to the surface of the degraded toner, that is, the toner in which the external additive is buried, even in the toner with a volume-average particle diameter of from 3.5 μm to 5.0 μm. Accordingly, between the initial toner replenished from the developer cartridge and the degraded toner in the developing unit, the difference in adhesive force of the toner to the photoreceptor is reduced, thereby effectively suppressing the transfer unevenness.

Toner Base Particle

The toner base particles include at least a binder resin and further include a release agent, a colorant, and optionally other additives.

Binder Resin

An example of the binder resin constituting the toner base particles includes an amorphous resin. The binder resin may include a crystalline resin along with the amorphous resin.

Known resin materials can be used as the amorphous resin, and an amorphous polyester resin can be preferably used. The amorphous polyester resin used in this exemplary embodiment is obtained by condensation-polymerizing polyvalent carboxylic acids and polyhydric alcohols.

The amorphous resin used in the toner base particles according to this exemplary embodiment preferably has a weight-average molecular weight (Mw) of from 5,000 (or about 5,000) to 1,000,000 (or about 1,000,000) when the molecular weight is measured by a gel permeation chromatography (GPC) of tetrahydrofuran (THF) solubles, and more preferably a weight-average molecular weight of from 7,000 to 500,000. The number-average molecular weight (Mn) thereof is preferably in the range of from 2,000 to 10,000, and the molecular weight distribution Mw/Mn is preferably in the range of from 1.5 to 100 and more preferably in the range of from 2 to 60.

When the weight-average molecular weight and the number-average molecular weight are in the above-mentioned ranges, coexistence of the low-temperature fixing ability, the hot offset resistance, and the document storage stability may become straightforward.

In this exemplary embodiment, the molecular weight of the resin is calculated, using a molecular weight correcting curve formed using a monodispersed polystyrene standard sample, by measuring a THF soluble with the THF solvent using GPC HLC-8120 (trade name, produced by TOSOH CORPORATION) and COLUMN TSK GEL SUPER HM-M (15 cm) (trade name, producted by TOSOH CORPORATION).

The acid value of the amorphous polyester resin (the value [mg] of KOH necessary for neutralizing 1 g of the resin) may be in the range of from 1 mg KOH/g to 30 mg KOH/g, from the viewpoints of easily obtaining the molecular weight distribution, easily guaranteeing the granulation of the toner particles using an emulsification dispersing method, or easily keeping the environmental stability of the obtained toner (the stability in charging property when the temperature and the humidity vary) excellent.

The acid value of the amorphous polyester resin may be adjusted by controlling a carboxy group at an end of polyester on the basis of the mixture ratio and the reaction rate of polyvalent carboxylic acid and polyhydric alcohol as raw materials. Alternatively, by using trimellitic anhydride as the polyvalent carboxylic component, it is possible to obtain polyester having a carboxy group in a main chain thereof.

A styrene acryl resin can be used as the known amorphous resin. Examples of the monomer thereof include styrenes such as styrene, parachlorostyrene, or α-methylstyrene; esters having a vinyl group such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, or 2-ethylhexyl methacrylate; vinyl nitriles such as acrylonitrile or methacrylonitrile; vinyl ethers such as vinylmethylether or vinylisobutylether; vinyl ketones such as vinylmethylketone, vinylethylketone, or vinylisoprophenylketone; polyolefins such as ethylene, propylene, or butadiene; polymer of the monomer, and a copolymer obtained by combining two or more monomers or mixtures thereof. Non-vinyl condensate resins such as an epoxy resin, a polyester resin, a polyurethane resin, a polyamide resin, a cellulose resin, or a polyether resin, mixtures of these resins and the vinyl resins, or graft polymers obtained at the time of polymerizing the vinyl monomer under coexistence may also be used.

The glass-transition temperature of the amorphous resin used in this exemplary embodiment is preferably in the range of from 35° C. (or about 35° C.) to 100° C. (or about 100° C.), and more preferably in the range of from 50° C. to 80° C., in view of the toner storage stability (suppression of aggregation due to vibrations or heat at the time of transport) and the balance in fixing ability of the toner.

When the glass-transition temperature of the amorphous resin is in the above-mentioned range, the blocking of the toner (a phenomenon where the toner particles are aggregated to form a lump) during storage or in a developing unit can be prevented and the fixing temperature of the toner can be lowered.

The softening point of amorphous resin is preferably in the range of from 80° C. (or about 80° C.) to 130° C. (or about 130° C.), and more preferably in the range of from 90° C. to 120° C.

When the softening point of the amorphous resin is in the above-mentioned range, the stability of the toner and the image stability (image defects such as image chipping or cracking at the time of bending) of the toner after the fixing and at the time of storage are excellent and the low-temperature fixing ability is excellent.

The softening point of the amorphous resin means a middle temperature between a melting start temperature and a melting end temperature under the conditions of a pre-heating rate of 80° C./300 sec, a plunger pressure of 0.980665 MPa, a die size of 1 mmϕ×1 mm, a temperature-raising rate of 3.0° C./min, using a flow tester CFT-500C (trade name, made by Shimadzu Corporation).

In this exemplary embodiment, the type of a toner base particle may include a release agent and is of a toner type including a core portion forming the center of a toner particle and a shell portion surrounding the core portion, in view of improving charging ability and storage stability.

When the amorphous resin and the crystalline resin are used together, the crystalline resin is not particularly limited as long as it is crystalline. Specifically, examples thereof include crystalline polyester resins and crystalline vinyl resins. The crystalline polyester resin is preferable and an aliphatic crystalline polyester resin is more preferable.

The crystalline polyester resin and the other polyester resins used in the toner according to this exemplary embodiment are synthesized from polyvalent carboxylic components and polyhydric alcohol components. In this exemplary embodiment, any commercialized product may be used as the polyester resin or any synthesized product may be used.

Examples of the crystalline vinyl resin include vinyl resins using (meth)acrylic ester of long chain alkyl and alkenyl, such as (meth)acrylic amyl, (meth)acrylic hexyl, (meth)acrylic heptyl, (meth)acrylic octyl, (meth)acrylic nonyl, (meth) acrylic decyl, (meth)acrylic undecyl, (meth)acrylic tridecyl, (meth)acrylate myristyl, (meth)acrylate cetyl, (meth)acrylic stearyl, (meth)acrylic oleil, (meth)acrylate behenyl.

In this specification, the description of "(meth)acryl" means including one of "acryl" or "methacryl".

The melting temperature of the crystalline resin is preferably in the range of from 50° C. to 100° C., more preferably in the range of from 55° C. to 80° C., and still more preferably in the range of from 60° C. to 70° C. When the melting temperature of the crystalline resin is in the above-mentioned range, the storage stability of the toner or the storage stability of the toner image after having been subjected to the fixing process may be excellent and the low-temperature fixing ability may be improved.

The crystalline resin may exhibit plural melting peaks, but the highest peak is considered as the melting point in this exemplary embodiment.

When the molecular weight is measured by the gel permeation chromatography (GPC) of tetrahydrofuran (THF) solubles, the weight-average molecular weight (Mw) of the crystalline resin is preferably in the range of from 5,000 to 60,000 and more preferably in the range of from 8,000 to 50,000. The number-average molecular weight (Mn) is preferably in the range of from 4,000 to 10,000. The molecular weight distribution Mw/Mn is preferably in the range of from 2 to 10 and more preferably in the range of from 3 to 9.

When the weight-average molecular weight and the number-average molecular weight are in the above-mentioned ranges, the low-temperature fixing ability and the hot offset resistance may be compatible with each other.

When the amorphous resin and the crystalline resin are used together, the content of the crystalline resin is preferably in the range of from 5% by weight to 30% by weight in the components of the toner base particles and more preferably in the range of from 8% by weight to 20% by weight.

When the content of the crystalline resin is in the above-mentioned range, the strength of the fixed image is great, particularly, the scratch resistance is great and thus scratches may not easily be made. In addition, it may be possible to obtain a sharp melting property resulting from the crystalline resin and to obtain the toner blocking resistance and the image storage stability while guaranteeing the low-temperature fixing ability.

In the toner base particles according to this exemplary embodiment, when the crystalline resin and the amorphous resin are used together as the binder resin, the resins may exist in any state in the toner. From the viewpoint that the crystalline resin on the surface of the toner improves the charging ability and the storage stability, it is preferable that the toner base particles include the crystalline resin in the core portion.

From the viewpoint that the crystalline resin and the amorphous resin are mutually dissolved to improve the storage stability, it is preferable that the core portion includes the crystalline resin and the amorphous resin.

The content ratio of the crystalline resin and the amorphous resin in the core portion is preferably in the range of 2:98 to 16:84 as a weight ratio of crystalline resin:amorphous resin, more preferably in the range of 3:97 to 16:84, and still more preferably in the range of 4:96 to 15:85.

From the viewpoint that the release agent and the crystalline resin are prevented from being exposed from the core portion to improve the charging ability and the storage stability, it is preferable that the shell portion includes the amorphous resin as the binder resin.

The content ratio of the crystalline resin and the amorphous resin in the shell portion is preferably in the range of 0:100 to 2:98 as a weight ratio of crystalline resin:amorphous resin, more preferably in the range of 0:100 to 1:99, and still more preferably in the range of 0:100 to 0.5:99.5.

Release Agent

Materials of which the main maximum peak measured based on ASTMD3418-8 is in the range of from 50° C. to 140° C. can be preferably used as the release agent used in the toner base particles according to this exemplary embodiment. When the main maximum peak is in the above-mentioned range, it is possible to suppress the offset at the time of fixation, and the smoothness and the gloss of the image surface are excellent.

For example, DSC-7 (trade name, made by PerkinElmer Co., Ltd.) is used to measure the main maximum peak. The melting points of indium and zinc are used to correct the temperature of a detection unit of the apparatus, and the melting heat of indium is used to correct the amount of heat. An aluminum pan is used as a sample, an empty pan is set for reference, and the measurement is made at a temperature-raising rate of 10° C./min.

The viscosity $\eta 1$ of the release agent at 160° C. is preferably in the range of from 20 mPaS to 200 mPaS. When the viscosity $\eta 1$ is in this range, the hot offset at the time of fixation at a high temperature and the excessive smearing of wax (hereinafter, also referred to as "wax offset") in the fixed image are suppressed.

The ratio ($\eta 2/\eta 1$) of the viscosity $\eta 1$ of the release agent at 160° C. and the viscosity $\eta 2$ at 200° C. are preferably in the range of from 0.5 (or about 0.5) to 0.7 (or about 0.7). When $\eta 2/\eta 1$ is in this range, the hot offset and the wax offset are suppressed and the peeling stability is excellent.

Examples of the release agent include low-molecular-weight polyolefins such as polyethylene, polypropylene, or polybutene, silicones having a softening point by heat, fatty acid amides such as oleic amide, erucamide, ricinoleic amide, or stearic amide, plant wax such as carnauba wax, rice wax, candelilla wax, Japan wax, or jojoba wax, animal wax such as bees wax, minerals such as montan wax, ozokerite, ceresin, paraffin wax, microcrystalline wax, or Fisher-Tropsch wax, kerosene wax, and modifiers thereof.

The release agent is dispersed in water along with an ionic surfactant or a polymer electrolyte such as a polymer acid or a polymer base, is heated at a temperature equal to or higher than a melting point, and is made into particles by a homogenizer or a pressure-ejecting disperser which can provide a strong shearing, whereby a release agent dispersion liquid including release agent particles with a particle diameter of 1 μM or less is produced.

The content of the release agent in the toner base particles is preferably in the range of from 0.5% by weight to 15% by weight and more preferably in the range of from 1% by weight to 12% by weight.

When the content of the release agent is in the above-mentioned range, the stable charging ability may be maintained over long-term use, and the smoothness and the gloss of the image surface may be excellent.

Colorant

The colorant used in the toner base particles according to this exemplary embodiment is not particularly limited, and known colorants can be used and selected depending on the purpose. Known organic or inorganic pigments or dyes, or oil-soluble dyes can be used as the colorant.

Examples of the black pigment include carbon black and magnetic powder.

Examples of the yellow pigment include hansa yellow, hansa yellow 10G, benzidine yellow G, benzidine yellow GR, serene yellow, quinoline yellow, and permanent yellow NCG.

Examples of the red pigment include colcothar, watchung red, permanent red 4R, lithol red, buririan carmine 3B, buririan carmine 6B, du pont oil red, pyrazolone red, rhodamine B lake, lake red C, rose bengal, eoxine red, and alizarin lake.

Examples of the blue pigment include prussian blue, cobalt blue, alkali blue lake, Victoria blue lake, fast sky blue, indathrene blue BC, aniline blue, ultra marine blue, calco oil blue, methylene blue chloride, phthalocyanine blue, phthalocyanine green, and malachite green oxalate. These pigments may be mixed and may be used in a solid-dissolved state.

The pigments are dispersed by known methods, but for example, a media type disperser such as a rotary-shearing homogenizer, a ball mill, a sand mill, or an attritor and a high-pressure crash type disperser may be used. A colorant particle dispersion liquid is produced by dispersing the pigment in a aqueous solvent using an ionic surfactant having polarity and using the above-mentioned homogenizer.

When a pigment is used as the colorant of the toner according to this exemplary embodiment, the above-mentioned pigments may be used alone or in combination of two or more pigments of the same type. Two or more pigments of different types may be combined and used.

Dyes may be used as the colorant of the toner according to this exemplary embodiment. Examples thereof include various dyes such as acridines, xanthens, azos, benzoquinones, azins, anthraquinones, dioxadins, thiazines, azomethines, indigos, thioindigos, phthalocyanines, aniline blacks, polymethines, triphenylmethanes, diphenylmethanes, thiazoles, xanthens. Further, examples thereof also include disperse dye and oil-soluble dye.

The dyes may be used alone or in combination of two or more dyes of the same type. Two or more dyes of different types may be combined and used. The pigments and the dyes may be used together.

The content of the colorant is preferably in the range of from 1% by weight to 30% by weight with respect to 100% by weight of the binder resin, and is preferably as high as possible in the numerical range as long as it does not damage the smoothness of the image surface after the fixation. When the content of the colorant is excessively high, the thickness of the image decreases, which is advantageous for preventing the offset, in an image with the same density.

The shape factor of the toner base particles is preferably in the range of from 115 (or about 115) to 140 (or about 140), more preferably in the range of from 118 to 138, and still more preferably in the range of from 120 to 136.

Here, the shape factor SF1 can be calculated by Formula 1.

$$SF1=(ML^2/A)\times(\pi/4)\times 100 \qquad \text{Formula 1}$$

In Formula 1, ML represents the absolute maximum length of the toner particles and A represents the projection area of the toner particles.

SF1 is digitalized by analyzing a microscopic image or a scanning electron microscope (SEM) image, using an image analyzer.

Production of Toner

The toner according to this exemplary embodiment may be produced by any one of a kneading and pulverizing method or a wet production method, and the method is not particularly limited. For example, in the kneading and pulverizing method, toner materials are first mixed and are then melted and kneaded using a kneader or an extruder. Then, the melted and kneaded material is pulverized into coarse particles and is pulverized into fine particles by a jet mill or the like, whereby toner particles with a desired particle diameter are obtained, using a wind classifier. An external additive is added thereto, thereby obtaining the final toner.

As the wet production method, a production method (so-called emulsification-polymerization flocculation method) including a flocculated particle forming step of adding one or more types of flocculants to a raw dispersion liquid including one or more types of raw particles and flocculating the one or more types of raw particles to form flocculated particles and a fusing step of fusing the flocculated particles by heating may be suitably employed.

Here, resin particles (constituting the binder resin) may be used as the raw particles in the wet production method, and colorant particles or release agent particles may be used as needed. When a polyester resin is used as the binder resin of the toner, particles including the polyester resin may be used as the resin particles. Accordingly, when two or more types of raw particles are used, a liquid including various types of raw particles dispersed therein is mixed to produce a raw dispersion liquid.

When a toner having a core-shell structure is produced, a coating layer forming step of adding one or more types of flocculants to a resin-particle dispersion liquid in which resin particles are dispersed in the raw dispersion liquid having been subjected to the flocculated particle forming step and attaching the resin particles to the surface of the flocculated particles to form the coating layer is first performed and then the fusing step is performed.

Here, when the step accompanying the flocculation of the raw particles is performed once in producing the toner (that is, when the flocculated particle forming step is performed), a flocculant including an Al element is used as the flocculant used in the flocculated particle forming step.

When the step accompanying the flocculation of the raw particles are performed twice or more in producing the toner (that is, when the flocculated particle forming step and the coating layer forming step are performed), a flocculant including an Al element is used as the flocculant used in at least several steps.

In this exemplary embodiment, by adjusting the amount of the flocculant including an Al element, the amount of Al on the surface of the toner base particles is controlled to be in the range of from 0.002 atm % to 0.02 atm %.

It is preferable that resin particles including a polyester resin are used as the resin particles used in the flocculated particle forming step or the coating layer forming step. Accordingly, the toner including the polyester resin is produced.

The steps of the flocculated particle forming step and the like will be described in detail.

Flocculated Particle Forming Step

In the flocculated particle forming step, a flocculant is added to a raw dispersion liquid obtained by mixing other dispersion liquid (such as a release agent dispersion liquid in which a release agent is dispersed), which is added as needed, with the resin particle dispersion liquid and the colorant dispersion liquid, and the resultant is heated, whereby flocculated particles in which the resultant particles are flocculated are formed. When the resin particles are formed of a crystalline resin such as crystalline polyester, the resultant is heated at the melting temperature of the crystalline resin and then at a temperature equal to or lower than the melting temperature to form the flocculated particles in which the resultant particles are flocculated.

The flocculated particles are formed by adding a flocculant at a room temperature under the agitation with the rotary-shearing homogenizer and adjusting the pH of the raw dispersion liquid to an acidic side.

As the flocculant used in the flocculated particle forming step, a bivalent or higher metal complex is suitably used in addition to a surfactant with the opposite polarity of the surfactant used as a dispersant added to the raw dispersion liquid, that is, an inorganic metal salt. When the metal complex is used, the amount of surfactant to be used is reduced and thus the charging ability is improved, which is preferable.

Examples of the inorganic metal salt include a metal salt such as calcium chloride, calcium nitride, barium chloride, magnesium chloride, zinc chloride, aluminum chloride, or aluminum sulfide and an inorganic metal salt polymer such as poly aluminum chloride, poly aluminum hydride, and poly calcium sulfide. Particularly, the aluminum salt and the polymer thereof are preferable. To obtain a sharper size distribution, divalent is more preferable than monovalent as the valence of the inorganic metal salt, trivalent is more preferable than divalent, tetravalent is more preferable than trivalent, and a polymerization type of inorganic metal salt polymer with the same valence is more preferable.

When the step using the flocculant at the time of producing the toner base particles includes only the flocculated particle forming step, the flocculant including an Al element is used as the flocculant in the step. When the step using the flocculant includes the flocculated particle forming step and the coating layer forming step, the flocculant including an Al element can be used as the flocculant in both steps or any one step.

Here, the above-mentioned examples such as poly aluminum chloride are used as the flocculant including an Al element.

To stop the flocculation reaction in the flocculated particle forming step or the coating layer forming step before performing the fusing step, the pH of the raw dispersion liquid is adjusted from the acidic side to the alkali side (the pH range of from 6.5 to 8.5) using an alkali solution such as sodium hydride after the flocculant is added in the conventional emulsification-polymerization flocculating method. Thereafter, subsequent steps such as the fusing step or the like are performed.

Coating Layer Forming Step

The coating layer forming step may be performed optionally after the flocculated particle forming step is performed. In the coating layer forming step, a coating layer is formed by attaching resin particles for forming the coating layer to the surface of the flocculated particles formed through the flocculated particle forming step. Accordingly, the toner having a so-called core-shell structure is obtained.

The formation of the coating layer is performed by further adding a resin particle dispersion liquid including amorphous resin particles to the raw dispersion liquid in which the flocculated particles (core particles) are formed in the flocculated particle forming step.

The surfactant is used in emulsification-polymerizing the binder resin, dispersing the pigment, dispersing the resin particles, dispersing the release agent, flocculating the particles, and stabilizing the flocculated particles. Specifically, anionic surfactant such as sulfate esters, sulfonates, phosphate esters, or soaps, cationic surfactant such as amine salts or quaternary ammonium salts, or nonionic surfactant such as polyethylene glycols, alkylphenolethylene oxide adducts or polyhydric alcohols can be effectively used together. Known apparatuses such as a rotary-shearing homogenizer, a ball mill having a medium, a sand mill, or a dyno mill are used as the dispersion unit.

Fusing Step

In the fusing step performed after the flocculated particle forming step or the flocculated particle forming step and the coating layer forming step, the progress of the flocculation is stopped by adjusting the pH of the suspension liquid including the flocculated particles formed through the above-mentioned steps to the range of from 6.5 to 10. When a second (Al)1/(Al)2 value control method is used, the pH of the suspension liquid is selected from the above-mentioned range. When the second (Al)1/(Al)2 value control method is used, the pH of the suspension liquid is adjusted into the range of from 9 to 10.

The flocculated particles are fused by stopping the progress of the flocculation and then heating the resultant. When the crystalline resin is used as the binder resin, the flocculated particles are fused by heating the resultant at a temperature equal to or higher than the melting temperature of the binder resin.

Washing and Drying Steps

After ending the step of fusing the flocculated particles, desired toner particles are obtained through an arbitrary washing step, a solid-liquid separating step, and a drying step. In consideration of the charging ability, it is preferable that the washing is performed with ion-exchange water in the washing step. The solid-liquid separating step is not particularly limited, and may employ sucking filtration, pressing filtration, or the like in view of productivity. The drying step is not particularly limited, and may employ freezing drying, flash jet drying, flowing drying, or vibrating and flowing drying in view of productivity.

Various external additives are added to the dried toner particles, whereby the final toner is completed.

External Additive

The external additive is not particularly limited, and examples thereof include the following inorganic particles or organic particles.

The inorganic particles are generally used to improve the fluidity.

Examples of the inorganic particles include silica, alumina, titanium oxide, barium titanate, magnesium titanate, calcium titanate, strontium titanate, zinc oxide, quartz sand, clay, mica, wollastonite, diatomaceous earth, cerium chloride, Bengala, chromium oxide, cerium oxide, antimony trioxide, magnesium oxide, zirconium oxide, silicon carbide, and silicon nitride.

Among the inorganic particles, titanium particles and silica particles are preferably used and particularly hydrophobized fine particles are preferably used. The inorganic particles may be subjected to various surface treatments, and the inorganic particles having been subjected to the surface treatment, for example, a silane coupling agent, a titanium coupling agent, or a silicone oil can be preferably used.

The primary particle diameter of the inorganic particles is preferably in the range of from 1 nm to 1000 nm and the inorganic particles are preferably externally added by a content of from 0.01 parts by weight to 20 parts by weight with respect to 100 parts by weight of the toner.

Examples of the organic particles include polystyrene, polymethylmethacrylate, and polyfluorovinylidene. The organic particles of which the surface is processed with a silicon compound or a fluorine compound may be preferably used. The organic particles are generally used to improve the cleaning property or the transfer property.

The primary particle diameter of the organic particles is in the range of from 10 nm to 5,000 nm and the organic particles are preferably externally added by a content of from 0.1 parts by weight to 10 parts by weight with respect to 100 parts by weight of the toner.

The content is more preferably in the range of 0.1 parts by weight to 5 parts by weight.

Other Additives

Various components such as an internal additive or a charging control agent in addition to the above-mentioned components may be added to the toner according to this exemplary embodiment optionally.

Examples of the internal additive include magnetic materials such as metals of ferrite, magnetite, reduced iron, cobalt, nickel, or manganese, alloys, and compounds including the metals.

Carrier

The carrier included in the developer according to this exemplary embodiment includes magnetic particles and a coating resin layer for coating the magnetic particles, the coating resin layer including organic particles with a volume-average particle diameter of from 80 nm (or about 80 nm) to 800 nm (or about 800 nm) or inorganic particles having an organic layer on the surface with a volume-average particle diameter of from 80 nm (or about 80 nm) to 800 nm (or about 800 nm), the carrier satisfying one of the following Formulas, where SP1 represents a solubility parameter of resin of the coating resin layer, SP2 represents a solubility parameter of the organic particles, and SP3 represents a solubility parameter of the organic layer on the surface of the inorganic particles:

$$10>|SP1-SP2|>4 \text{ (or about } 10>|SP1-SP2|>\text{about } 4) \quad (1); \text{ and}$$

$$10>|SP1-SP3|>4 \text{ (or about } 10>|SP1-SP3|>\text{about } 4) \quad (2).$$

When the SP difference ($|SP1-SP2|$ or $|SP1-SP3|$) between the coating resin and the particle surface is equal to or greater than about 10, the particles may not be uniformly dispersed in the resin layer at the time of production. When the SP difference is equal to or less than about 4, the affinity between both is good and thus the particles may be difficult to separate. Accordingly, the organic particles or the inorganic particles included in the coating resin layer of the carrier are difficult to attach to the surface of the degraded toner, thereby not obtaining a transfer supporting effect.

Magnetic Particles

The magnetic particles are not particularly limited, and examples thereof include magnetic metals such as iron, steel, nickel, or cobalt or magnetic oxides such as ferrite or magnetite.

The volume-average particle diameter of the magnetic particles is preferably in the range of from 10 μm to 50 μm.

Coating Resin Layer

The coating resin layer with which the magnetic particles are coated is a layer including a resin, organic particles with a volume-average particle diameter of from about 80 nm to about 800 nm or inorganic particles having an organic layer on the surface with a volume-average particle diameter of from about 80 nm to about 800 nm. The carrier satisfies any one of the above-mentioned Formulas 1 and 2, where SP1 represents the solubility parameter of resin of the coating resin layer, SP2 represents the solubility parameter of the organic particles, and SP3 represents the solubility parameter of the organic layer.

Here, the SP value (Solubility Parameter) will be described. The SP represents the solubility parameter and is obtained by quantifying the degree by which two materials are mutually dissolved. The SP value is expressed as the attraction between molecules, that is, a square root of the cohesive energy density (CED). The CED means an amount of energy required to evaporate 1 mL of the material. The Formula for calculating the SP value at 25° C. is described below.

$$\text{SP value (Solubility Parameter)}=(\text{CED value})^{1/2}=(E/V)^{1/2}$$

In the Formula, E represents a molecular cohesion energy (cal/mol) and is expressed as $E=\Sigma ei$. Here, ei represents evaporation energy. V represents a molecular volume ($cm^3$/mol) and is expressed as $V=\Sigma vi$ (where vi is a mole volume).

Various methods can be used to calculate the SP value, but the Fedors method which is used in general is used in this exemplary embodiment. This calculation method, calculation methods of the ei (evaporation energy) and the vi (mole volume) of each atom group, and all data are referred to in "Basic Theory of Adhesion, written by Imoto Minoru, Polymer Journal, Chapter 5".

Here, "cal" is used in the unit because most values described in general polymer journals are expressed in units of "cal". Regarding J (Doul) as the actual SI unit, the conversion Formula "1 cal=4.18605 J" is used. "MJ/$cm^3$" is expressed in J/$cm^3$ after calculation. "—$CF_3$ group" and the like which are not shown are referred to in R. F. Fedors, Polym. Eng. Sci. 14, 147-154 (1974). The SP values based on this document are used as reference in this exemplary embodiment, but when the SP values are obtained by actually measuring a used material, such SP values may be used.

The disclosure of the above publication is incorporated by reference herein.

Regarding the SP values, the carrier according to this exemplary embodiment is configured to satisfy the above-mentioned Formulas 1 and 2 when SP1 represents the solubility parameter of resin of the coating resin layer with which the magnetic particles are coated, SP2 represents the solubility parameter of the organic particles, and SP3 represents the solubility parameter of the organic layer on the surface of the inorganic particles.

Examples of the resin constituting the coating resin layer of the carrier include polyethylene, polypropylene, polystyrene, polyvinyl acetate, polyvinyl alcohol, polyvinyl butyral, polyvinyl chloride, polyvinyl ether, polyvinyl ketone, vinylchloride-vinylacetate copolymer, styrene-acrylate copolymer, a straight silicon resin having an organosiloxane bond or a modifier thereof, an amino resin such as fluorine resins, polyester, polycarbonate, phenol resins, urea-formaldehyde resins, melamine resins, silicon resins, benzoguanamine resins, urea resins, or polyamide resins, and epoxy resins, but the invention is not limited to these examples. Among these, the fluorine resin may be preferably used from the viewpoint of prevention of attachment to the surface of the carrier for a reason other than the charging ability of the toner, and the acryl resin (for example, which is obtained by polymerizing polymerizable monomers including perfluoropropylethyl methacrylate) having a perfluoro group may be also preferably used from the viewpoint of adhesion to the magnetic particles. These may be used alone or in combination of two or more thereof.

Examples of the organic particles included in the coating resin layer include fluorine-including resins such as polytetrafluoroethylene or polyfluorovinylidene, polyolefin resins such as polyethylene or polypropylene, polyvinyl and polyvinylidene resins such as polystyrene, an acryl resin, polyacrylonitrile, polyvinylacetate, polyvinyl alcohol, polyvinylbutyral, poly vinyl chloride, polyvinyl carbazole, polyvinylether, or polyvinyl ketone, vinylchloride-vinylacetate copolymer, styrene-acrylate copolymer, straight silicon resins having an organosiloxane bond or a modifier thereof, polyester, and polycarbonate. Cured resin particles can be produced using a crosslink component such as divinyl benzene at the same time as forming the resin.

Examples of the thermoset resin include phenol resins, amino resins such as urea-formaldehyde resins, melamine resins, benzoguanamine resins, urea resins, or polyamide resins, and epoxy resins. Among these, the fluorine-including resins may be preferably used from the viewpoint of suppression of the transfer unevenness.

Examples of the inorganic particles included in the coating resin layer and surface-processed include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O(TiO_2)_n$, $Al_2O_3.2SiO_2$, $CaCO_3$, $MgCO_3$, $BaSO_4$, and $MgSO_4$. Examples of the organic layer (surface treating agent) for processing the surface of the inorganic particles include trimethanol amine, alkylchlorosilanes such as hexamethylsilazane, methyltrichlorosilane, octyltrichlorosilane, or dimethylchlorosilane, alkylmethoxysilanes such as dimethyldimethoxysilane or octyltrimethoxysilane, hexamethyldisilazane, a silylation agent, silicon oil, and a titanate or aluminum coupling agent. Among these, trimethanol amine and triethanol amine may be used from the viewpoint of suppression of the transfer unevenness.

When the volume-average particle diameters of the organic particles included in the coating resin layer and the inorganic particles in which the organic layer (surface treating agent) is attached to the surface thereof is about 80 nm or more, the separation from the coating resin layer of the resin may be easily caused and a sufficient transfer assisting effect can be exhibited. On the other hand, when the volume-average particle diameter is equal to or less than about 800 nm, the separation may not be easily caused with a slight stress and the adhesive force is strong. Accordingly, the toner may be easily degraded after the separation from the coating resin layer. From these viewpoints, it may be preferable that the volume-average particle diameter of the particles included in the coating resin layer is in the range of from 100 nm to 400 nm.

Electrophotographic Developer

The developer according to this exemplary embodiment is produced by mixing the toner and the carrier. The mixture ratio of the toner and the carrier (weight ratio, toner:carrier) is preferably in the range of 5:95 to 20:80 and more preferably in the range of 8:92 to 12:88, from the viewpoints of an appropriate amount of charges and a narrow charge amount distribution.

When the developer according to this exemplary embodiment is used as a replenishing developer of a so-called trickle developing type, the mixture ratio of the carrier is preferably in the range of 80:20 to 99.5:0.5 and more preferably in the range of 90:10 to 98:2. When the developer including the toner and the carrier by the above-mentioned weight ratio is supplied to a developing unit to perform a development process, the particles are continuously separated from the coating resin layer of the carrier supplied to the developing unit and are attached to the surface of the degraded toner.

Image Forming Apparatus

An image forming apparatus according to this exemplary embodiment using the developer according to this exemplary embodiment will be described.

The image forming apparatus according to this exemplary embodiment includes: a photoreceptor; a charging unit that charges the surface of the photoreceptor; an electrostatic latent image forming unit that forms an electrostatic latent image on the charged surface of the photoreceptor; a developing unit that develops the electrostatic latent image formed on the photoreceptor into a toner image, using the above-mentioned electrophotographic developer; and a transfer unit that transfers the toner image to a transfer medium. The image forming apparatus according to this exemplary embodiment may further include other units such as a fixing unit that fixes a toner image transferred to the transfer medium such as paper and a cleaning unit that brings a cleaning member into a frictional contact with the photoreceptor to remove and clean the post-transfer remaining components, optionally.

Hereinafter, an example of the image forming apparatus according to this exemplary embodiment will be described, but the invention is not limited to this example. The principal parts shown in the drawing will be described and the other parts will not be described.

In the image forming apparatus, for example, a section including the developing unit may have a cartridge structure (process cartridge) which can be detachably attached to the image forming apparatus. A process cartridge which includes at least a developer holding member and includes the electrophotographic developer according to this exemplary embodiment may be used as the process cartridge.

FIG. 1 is a diagram schematically illustrating the configuration of a 4-drum tandem color image forming apparatus as an example of the image forming apparatus according to this exemplary embodiment. The image forming apparatus shown in FIG. 1 includes first to fourth image forming units 10Y, 10M, 10C, 10K (image forming unit) of an electrophotographic type outputting color images of yellow (Y), magenta (M), cyan (C), and black (K) based on color-separated image data. The image forming units (hereinafter, simply referred to as "units") 10Y, 10M, 10C, and 10K are arranged with a predetermined distance therebetween in the horizontal direction. The units 10Y, 10M, 10C, and 10K may be process cartridges which can be attached to and detached from the image forming apparatus.

An intermediate transfer belt 20 as an intermediate transfer member extends via the units above the units 10Y, 10M, 10C, and 10K in the drawing. The intermediate transfer belt 20 is wound on a driving roller 22 and a support roller 24 contacting the inner surface of the intermediate transfer belt 20, which are separated from each other on the left and right sides in the drawing, and travels from the first unit 10Y to the fourth unit 10K. The support roller 24 is urged in the direction in which it gets away from the driving roller 22 by a spring or the like not shown and thus a tension is given to the intermediate transfer belt 20 wound on both rollers. An intermediate transfer member cleaning device 30 opposed to the driving roller 22 is disposed in the side surface of the intermediate transfer belt 20 facing the image holder.

The developing devices (developing units) 4Y, 4M, 4C, and 4K of the units 10Y, 10M, 10C, and 10K are supplied with developers of four colors of yellow, magenta, cyan, and black included in the developer cartridges 8Y, 8M, 8C, and 8K, respectively.

To correspond to the unit 10Y, as shown in FIG. 1, the units 10M, 10C, and 10K include the photoreceptors 1M, 1C, and 1K, the charging rollers 2M, 2C, and 2K, laser beams 3M, 3C, and 3K, and the photoreceptor cleaning units 6M, 6C, and 6K.

The first to fourth units 10Y, 10M, 10C, and 10K have the same configuration, and thus only the first unit 10Y for forming a yellow unit disposed upstream in the traveling direction of the intermediate transfer belt will be representatively described. The same elements as the first unit 10Y are referenced by reference numerals having magenta (M), cyan (C), and black (K) added instead of yellow (Y), and the second to fourth units 10M, 10C, and 10K are not described.

The first unit 10Y includes the photoreceptor 1Y serving as an image holder. Around the photoreceptor 1Y, a charging roller 2Y charging the surface of the photoreceptor 1Y to a predetermined potential, an exposure device 3 exposing the charged surface with a laser beam 3Y based on a color-separated image signal to form an electrostatic latent image, a developing device (developing unit) 4Y supplying a charged toner to the electrostatic latent image to develop the electrostatic latent image, a primary transfer roller (primary transfer unit) 5Y transferring the developed toner image onto the intermediate transfer belt 20, and a photoreceptor cleaning device (cleaning unit) 6Y removing the toner remaining on the surface of the photoreceptor 1Y after the primary transfer are arranged in this order.

The primary transfer roller 5Y is disposed inside the intermediate transfer roller 20 and is located at a position opposed to the photoreceptor 1Y. Bias sources (not shown) applying a primary transfer bias are connected to the primary transfer rollers 5Y, 5M, 5C, and 5K, respectively. The bias sources vary the transfer bias applied to the primary transfer rollers under the control of a controller not shown.

The image forming apparatus shown in FIG. 1 is an image forming apparatus having a structure which the developer cartridges 8Y, 8M, 8C, and 8K can be detachably attached to, and the developing devices 4Y, 4M, 4C, and 4K are connected to the developer cartridges 8Y, 8M, 8C, and 8K corresponding to the developing devices (colors) via toner supply pipes not shown. The developing devices 4Y, 4M, 4C, and 4K are connected to developer discharge pipes (not shown) discharging excessive degraded developers (including a lot of degraded carrier). According to this configuration, a so-called trickle developing method (a developing method of performing a development operation while slowly supplying the replenishing developer (trickle developer) to the developing device and discharging the excessive degraded developer (including a lot of degraded carrier)) is employed.

When the developer cartridges 8Y, 8M, 8C, and 8K receiving the electrophotographic developer are employed and almost the overall developer received in a developer cartridge is used, the developer cartridge is replaced.

The operation of forming a yellow image in the first unit 10Y will be described below. First, before the operation, the surface of the photoreceptor 1Y is charged to a potential of from −600 V to −800 V by the charging roller 2Y.

The photoreceptor 1Y is formed by laminating a photoconductive layer on a conductive base (with a volume resistivity of $1\times10^{-6}$ Ωcm or less at 20° C.). This photoconductive layer typically has high resistance (corresponding to the resistance of general resin), but has a feature that the specific resistance of a section to which a laser beam is applied when the laser beam 3Y is applied thereto. Here, the laser beam 3Y is emitted to the surface of the charged photoreceptor 1Y from the exposure device 3 in accordance with yellow image data sent from the controller not shown. The laser beam 3Y is applied to the photoconductive layer on the photoreceptor 1Y, whereby an electrostatic latent image of a yellow print pattern is formed on the surface of the photoreceptor 1Y.

The electrostatic latent image is an image formed on the surface of the photoreceptor 1Y by the charging, and is a so-called negative latent image which is formed by applying the laser beam 3Y to a part of the photoreceptor to lower the specific resistance of the applied section to cause charges to flow on the surface of the photoreceptor 1Y and to cause charges to remain in the section to which the laser beam 3Y is not applied.

The electrostatic latent image formed on the photoreceptor 1Y is rotated to a predetermined developing position with the rotation of the photoreceptor 1Y. The electrostatic latent image on the photoreceptor 1Y is visualized (to form a toner image) at the developing position by the developing device 4Y.

A yellow toner is received in the developing device 4Y. The yellow toner is frictionally charged by the agitation in the developing device 4Y to have charges with the same polarity (negative polarity) as the electrified charges on the photoreceptor 1Y and is held on the developer roller (developer holder). By causing the surface of the photoreceptor 1Y to pass through the developing device 4Y, the yellow toner is electrostatically attached to the latent image section having no charge on the photoreceptor 1Y, whereby the latent image is developed with the yellow toner. The photoreceptor 1Y having a yellow toner image formed thereon travels continuously at a predetermined speed and the toner image developed on the photoreceptor 1Y is carried to a predetermined primary transfer position.

When the yellow toner image on the photoreceptor 1Y is carried to the primary transfer position, a predetermined primary transfer bias is applied to the primary transfer roller 5Y and an electrostatic force in the direction from the photoreceptor 1Y to the primary transfer roller 5Y acts on the toner image, whereby the toner image on the photoreceptor 1Y is transferred to the intermediate transfer belt 20. The transfer bias applied at this time has the opposite polarity (+) of the toner polarity (−) and is controlled to be about +10 μA in the first unit 10Y by the controller (not shown).

On the other hand, the toner remaining on the photoreceptor 1Y is removed and recovered by the cleaning device 6Y.

The primary transfer biases applied to the primary transfer rollers 5M, 5C, and 5K of from the second unit 10M and the subsequent units thereof are controlled similarly to the first unit.

In this way, the intermediate transfer belt 20 onto which the yellow toner image is transferred in the first unit 10Y is sequentially carried through the second to fourth units 10M, 10C, and 10K and the toner images of the colors are repeatedly and multiply transferred thereto.

The intermediate transfer belt 20 onto which four color toner images are multiply transferred by the first to fourth units reaches a secondary transfer unit including the intermediate transfer belt 20, the support roller 24 contacting the inner surface of the intermediate transfer belt 20, and a secondary transfer roller (secondary transfer unit) 26 disposed on the image holding side of the intermediate transfer belt 20. On the other hand, a recording sheet (recording medium) P is fed to a pressed gap between the secondary transfer roller 26 and the intermediate transfer belt 20 at a predetermined time by a feed mechanism and a predetermined secondary transfer bias is applied to the support roller 24. The transfer bias applied at this time has the same polarity (−) as the toner polarity (−) and an electrostatic force in the direction from the intermediate transfer belt 20 to the recording sheet P acts on the toner image, whereby the toner image on the intermediate transfer belt 20 is transferred onto the recording sheet P. The secondary transfer bias is determined depending on the resistance detected by a resistance detector (not shown) detecting the resistance of the secondary transfer unit and is voltage-controlled.

Thereafter, the recording sheet P is fed to the fixing device 28, the toner image is heated, and the color-superposed toner image is melted and fixed onto the recording sheet P. The recording sheet P onto which the color image is completely fixed is fed to the discharge unit and a series of color image forming operations are ended in this way.

Although the image forming apparatus has the configuration in which the toner image is transferred to the recording sheet P via the intermediate transfer belt 20, the apparatus is not limited to this configuration. The apparatus may have a structure in which the toner image is transferred directly to the recording sheet from the photoreceptor.

When the electrophotographic developer according to this exemplary embodiment is received in the developing devices 4Y, 4M, 4C, and 4K, the toner images are formed on the surfaces of the photoreceptors, and the toner images of the colors are superposed to form a high-density image, the difference in adhesive force between the degraded toner and the initial toner is small, thereby suppressing the transfer unevenness. When the developer according to this exemplary embodiment is replenished from the developer cartridges 8Y, 8M, 8C, and 8K to the developing devices 4Y, 4M, 4C, and 4K, respectively, the initial toner is continuously supplied along with the initial carrier, thereby suppressing the transfer unevenness for a long time.

Developer Cartridge

The developer cartridge may have a configuration which receives the electrophotographic developer according to this exemplary embodiment, supplies the electrophotographic developer to the developing unit developing an electrostatic latent image formed on the photoreceptor to form a toner image, and detachably attached to from the image forming apparatus. When almost the overall developer in the developer cartridge is used, the developer cartridge is replaced. Accordingly, the initial carrier is continuously supplied to the developing device, thereby suppressing the transfer unevenness for a long time.

Process Cartridge

The process cartridge may have a configuration which is detachably attached to an image forming apparatus and which includes at least one of a developing unit that develops an electrostatic latent image formed on a photoreceptor into a toner image, using the electrophotographic developer according to this exemplary embodiment; a charging unit that charges the surface of the photoreceptor; an electrostatic latent image forming unit that forms the electrostatic latent image on the charged surface of the photoreceptor; a transfer unit that transfers the toner image formed on the photoreceptor onto a transfer medium; a cleaning unit that removes a toner residual remaining on the surface of the photoreceptor after transferring the toner image; and a developer cartridge that supplies a replenishing developer to the developing unit. Particularly, the process cartridge having the developer cartridge and supplying the electrophotographic developer according to this exemplary embodiment as the replenishing developer may be used. Accordingly, the initial carrier is continuously supplied to the developing device, thereby suppressing the transfer unevenness for a long time.

Figure 2:
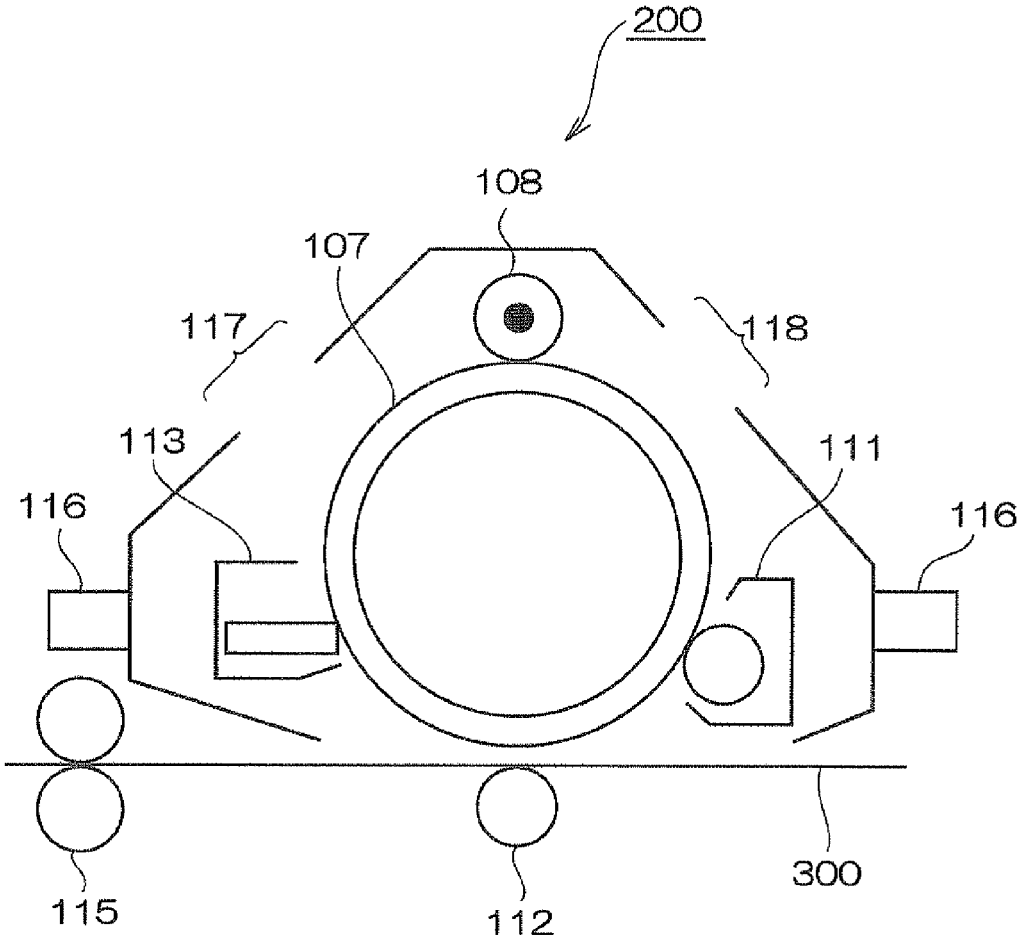
FIG. 2 is a diagram schematically illustrating the configuration of a process cartridge according to an exemplary embodiment of the present invention.

FIG. 2 is a diagram schematically illustrating an example of the process cartridge including the electrophotographic developer according to this exemplary embodiment. The process cartridge 200 includes a developer cartridge not shown, a developing device 111, a photoreceptor 107, a charging roller 108, a photoreceptor cleaning device 113, an exposure opening 118, and an electricity-removing exposure opening 117, which are combined into a body using a mounting rail 116. Reference numeral 300 in FIG. 2 represents a transfer medium.

The process cartridge 200 can be detachably attached to the image forming apparatus body including a transfer device 112, a fixing device 115, and other elements not shown, and forms an image forming apparatus in cooperation with the image forming apparatus body.

The process cartridge 200 shown in FIG. 2 includes the developer cartridge (not shown), the developing device 111, the photoreceptor 107, the charging device 108, the cleaning device 113, the exposure opening 118, and the electricity-removing exposure opening 117, but these elements may be selectively combined. The process cartridge according to this exemplary embodiment may include the developer cartridge (not shown), the developing device 111, and at least one selected from the group including the photoreceptor 107, the charging device 108, the cleaning device (cleaning unit) 113, the exposure opening 118, and the electricity-removing exposure opening 117.

EXAMPLES

This exemplary embodiment will be described in more detail with reference to examples, but this exemplary embodiment is not limited to the examples. As long as any particular description is not given, "parts" and "%" are based on weight in the following description.

Production of Toner

Production of Amorphous Polyester Resin (A1) and Amorphous Resin Particle Dispersion Liquid (a1)

15 parts by mol of polyoxyethylene(2,0)-2,2-bis(4-hydroxyphenyl) propane, 85 parts by mol of polyoxyethylene (2,2)-2,2-bis(4-hydroxyphenyl) propane, 10 parts by mol of terephthalic acid, 67 parts by mol of fumaric acid, 3 parts by mol of n-dodecenyl succinic acid, 20 parts by mol of trimellitic acid, and 0.05 parts by mol of dibutyl tin oxide with respect to these acid components (the total mole number of terephthalic acid, n-dodecenyl succinic acid, trimellitic acid, and fumaric acid) are introduced into a two-necked flask which is heated and dried, nitrogen gas is introduced into the flask to maintain the inert gas atmosphere, the temperature is raised, and then a co-condensation polymerization reaction is made at 150° C. to 230° C. for 12 hours to 20 hours. Thereafter, it is slowly depressurized at 210° C. to 250° C., whereby the amorphous polyester resin (A1) is synthesized. The weight-average molecular weight Mw of the resin is 65,000 and the glass-transition temperature Tg is 65° C.

3,000 parts of the acquired amorphous polyester resin, 10,000 parts of the ion-exchange water, and 90 parts of sodium dodecylbenzenesulfonate surfactant are introduced into an emulsification tank of a high-temperature and high-pressure emulsification device (CAVITRON CD1010, slit: 0.4 mm), the resultant is heated and dissolved at 130° C., the resultant is dispersed at 110° C. by 10,000 revolutions at a flow rate of 3 L/m for 30 minutes, and the resultant is made to pass through a cooling tank to recover an amorphous resin particle dispersion liquid (high-temperature and high-pressure emulsification device (CAVITRON CD1010, slit: 0.4 mm, trade name)), whereby an amorphous resin particle dispersion liquid (a1) is acquired.

Production of Crystalline Polyester Resin (B1) and Crystalline Resin Particle Dispersion Liquid (b1)

45 parts by mol of 1,9-nonanediol, 55 parts by mol of dodecanedicarboxylic acid, and 0.05 parts by mol of dibutyl tin oxide as a catalyst are introduced into a three-necked flask which is heated and dried, nitrogen gas is introduced into the flask to maintain the air in the flask in the inert gas atmosphere by under reduced pressure, and the resultant is agitated at 180° C. for 2 hours by mechanical agitation. Thereafter, the temperature is slowly raised up to 230° C. under the decompressed pressure, the resultant is agitated for 5 hours, and the resultant is cooled by air in a thickened state, and the reaction is stopped, whereby the crystalline polyester resin (B1) is synthesized. The weight-average molecular weight Mw of the resin is 25,000 and the melting point Tm is 73° C.

Thereafter, the crystalline resin particle dispersion liquid (b1) is acquired using the high-temperature and high-pressure emulsification device (CAVITRON CD1010, slit: 0.4 mm) under the same condition as producing the amorphous resin dispersion liquid (A1).

Production of Colorant Particle Dispersion Liquid (c)

Cyan pigment (PIGMENT BLUE 15:3 (copper phthalocyanine), trade name, made by Dainichiseika Color & Chemicals Mfg. Co., Ltd.): 1,000 parts Anionic surfactant (NEOGEN SC, trade name, made by Dai-Ichi Kogyo Seiyaku Co., Ltd.): 150 parts Ion-exchange water: 4,000 parts The above materials are mixed, dissolved, and dispersed for 1 hour by using a high-pressure impact disperser ULTIMAIZER (HP30006, trade name, made by Sugino Machine Co., Ltd.), whereby a colorant particle dispersion liquid in which colorant (cyan pigment) particles are dispersed is produced. The volume-average particle diameter of the colorant (cyan pigment) particles in the colorant particle dispersion liquid is 0.15 μm and the colorant particle concentration is 20%.

Production of Colorant Particle Dispersion Liquid (m)

Magenta pigment (C.I. PIGMENT RED 122, trade name, made by CLARIANT International Co., Ltd.): 1,000 parts Anionic surfactant (NEOGEN RK, trade name, made by Dai-Ichi Kogyo Seiyaku Co., Ltd.): 150 parts Ion-exchange water: 4,000 parts The above materials are mixed, dissolved, and dispersed for 1 hour by using a high-pressure impact disperser ULTIMAIZER (HJP30006, trade name, made by Sugino Machine Co., Ltd.), whereby a colorant particle dispersion liquid in which colorant (magenta pigment) particles are dispersed is produced. The volume-average particle diameter of the colorant (magenta pigment) particles in the colorant particle dispersion liquid is 0.15 μm and the colorant particle concentration is 20%.

Production of Colorant Particle Dispersion Liquid (y)

Yellow pigment (C.I. PIGMENT YELLOW 74, trade name, made by CLARIANT International Co., Ltd.): 1,000 parts Anionic surfactant (NEOGEN RK made by Dai-Ichi Kogyo Seiyaku Co., Ltd.): 150 parts Ion-exchange water: 4,000 parts The above materials are mixed, dissolved, and dispersed for 1 hour by using a high-pressure impact disperser ULTIMAIZER (HJP30006, trade name, made by Sugino Machine Co., Ltd.), whereby a colorant particle dispersion liquid in which colorant (yellow pigment) particles are dispersed is produced. The volume-average particle diameter of the colorant (yellow pigment) particles in the colorant particle dispersion liquid is 0.15 μm and the colorant particle concentration is 20%.

Production of Release Agent Particle Dispersion Liquid (1)

Wax (WEP-2, trade name, made by NOF CORPORATION, the company name of which is changed in 2007): 100 parts Anionic surfactant (NEOGEN SC, trade name, made by Dai-Ichi Kogyo Seiyaku Co., Ltd.): 2 parts Ion-exchange water: 300 parts The above materials are heated at 95° C., are dispersed with a homogenizer (ULTRA TURRAX T50, trade name, made by IKA Corporation), and are then dispersed with a pressure-ejecting GAULIN HOMOGENIZER (trade name, made by GAULIN Corporation), whereby a release agent particle dispersion liquid (1) in which release agent particles (release agent concentration: 20% by weight) with a volume-average particle diameter of 200 nm are dispersed is produced.

Production of Toner Base Particles A-c, A-m, and A-y

Amorphous resin particle dispersion liquid (a1): 340 parts

Crystalline resin particle dispersion liquid (b1): 160 parts

Colorant particle dispersion liquid (c): 50 parts

Release agent particle dispersion liquid (1): 60 parts
Aluminum sulfate (made by Wako Pure Chemical Industries Co., Ltd.): 5 parts
Surfactant aqueous solution: 10 parts
0.3M nitric acid aqueous solution: 50 parts
Ion-exchange water: 500 parts The above components are introduced into a round stainless flask, are dispersed with a homogenizer (ULTRA TURRAX T50, trade name, made by IKA Corporation), and are maintained in a heating oil bath heated up to 42° C. for 30 minutes. Then, the temperature of the heating oil bath is raised up to 58° C., the resultant is maintained therein for 30 minutes, 100 parts of the amorphous resin particle dispersion liquid (a1) is added thereto at the time of confirming that flocculated particles are formed, and the resultant is maintained in this state for 30 minutes.

Subsequently, a sodium nitrilotriacetate salt (CHELEST 70, trade name, made by CHELEST Corporation) is added thereto to occupy 3% of the total solution. Thereafter, 1N sodium hydride aqueous solution is slowly added thereto until the pH reaches 7.2, and the resultant is heated up to 85° C. with the continuous agitation and is maintained for 2.0 hours. Thereafter, the reaction product is filtrated, and the resultant is washed with the ion-exchange water and is dried with a vacuum drier, whereby toner base particle A-c.

Similarly, by replacing the colorant particle dispersion liquid (c) with the colorant particle dispersion liquid (m) and the colorant particle dispersion liquid (y) respectively, toner base particles A-m and A-y are acquired.

Toner Base Particle B

Except that the sodium nitrilotriacetate salt is added to occupy 1% of the total solution, toner base particles B-c, B-m, and B-y are produced similarly to toner base particle A.

Toner Base Particle C

Except that the sodium nitrilotriacetate salt is added to occupy 8% of the total solution, toner base particles C-c, C-m, and C-y are produced similarly to toner base particle A.

Toner Base Particle D

Except that the sodium nitrilotriacetate salt is not added, toner base particles D-c, D-m, and D-y are produced similarly to toner base particle A.

Toner Base Particle E

Except that the sodium nitrilotriacetate salt is added to occupy 15% of the total solution, toner base particles E-c, E-m, and E-y are produced similarly to toner base particle A.

Production of Toner Base Particles F-c, F-m, and F-y
Amorphous resin particle dispersion liquid (a1): 340 parts
Colorant particle dispersion liquid (c): 50 parts
Release agent particle dispersion liquid (1): 60 parts
Aluminum sulfate (made by Wako Pure Chemical Industries Co., Ltd.): 5 parts
Surfactant aqueous solution: 10 parts
0.3M nitric acid aqueous solution: 50 parts
Ion-exchange water: 500 parts Except the above description, toner base particles F-c, F-m, and F-y are produced similarly to toner base particle A. (toner not including a crystalline resin)

Production of Toner
Toner base particle A-c: 100 parts by weight
Gas-phase processed silica with a volume-average particle diameter of 40 nm processed with silicon oil: 1.5 parts by weight
Sol-gel silica with a volume-average particle diameter of 150 nm processed with HMDS (hexamethyldisilazane): 2.0 parts by weight The toner base particle A-c and an external additive are mixed using a Henschel mixer to obtain a toner.

Other toner base particles are mixed with the external additive to obtain toners TN-A-c to TN-F-y.

The volume-average particle diameter of the obtained toner base particles is measured with an aperture diameter of 50 μm using MULTISIZER II (trade name, made by Beckman Coulter Inc.).

The amount of Al on the surface of the toner base particles is measured by the following method.

2 g of the toner is dispersed in 40 mL of the aqueous solution of 0.2% by weight of surfactant (polyoxyethylene octylphenylether made by Wako Pure Chemical Industries, Ltd.), and ultrasonic vibrations are applied thereto under the conditions of power of 60 W, frequency of 20 kHz, and time of 60 min, using an ultrasonic generator model US-300 TCVP (trade name, made by Nippon Seiki Co., Ltd.), whereby the external additive is removed from the surface of the toner. The toner remaining in the dispersion liquid is filtrated and the content of the aluminum element in the toner is measured by the electron spectroscopy for chemical analysis (ESCA).

In this exemplary embodiment, the equipment and the measuring condition of the ESCA are as follows.

Equipment: 1600S X-ray Photoemission Spectrometer made by PHI (Physical Electronics Industries Inc.)
Measuring condition: X-ray source MgKα (400 W)
Spectroscopic area: diameter of 800 μm The diameters (volume-average particle diameter) of the toner base particles and the amounts of Al on the surfaces are shown in Table 1

TABLE 1

| toner base particle | particle diameter (μm) | amount of Al on surface |
|---|---|---|
| A-c | 4.2 | 0.006 |
| A-m | 4.1 | 0.005 |
| A-y | 4.2 | 0.006 |
| B-c | 4.1 | 0.003 |
| B-m | 4.1 | 0.003 |
| B-y | 4.1 | 0.002 |
| C-c | 4.3 | 0.018 |
| C-m | 4.2 | 0.017 |
| C-y | 4.2 | 0.017 |
| D-c | 4.2 | 0.001 |
| D-m | 4.1 | 0.001 |
| D-y | 4.2 | 0.001 |
| E-c | 4.1 | 0.028 |
| E-m | 4.2 | 0.026 |
| E-y | 4.1 | 0.027 |
| F-c | 4.2 | 0.006 |
| F-m | 4.1 | 0.006 |
| F-y | 4.2 | 0.006 |

Production of Carrier

Preparation of Coating Resin Layer-Forming Dispersion Liquid 1

Toluene solution (solid concentration: 10%) of perfluoropropylethylmethacrylate/methylmethacrylate (MMA) copolymer (co-polymerization ratio of 30:70 and molecular weight of 120,000): 900 parts by weight
Silica particle of 300 nm of which the surface is processed by triethanolamine: 10 parts by weight The above components are agitated along with glass beads (ϕ 1 mm, 200 parts) at a rate of 1,200 ppm/30 min using a sand mill made by Kansai Paint Co., Ltd. and the glass beads are removed, whereby coating resin layer-forming dispersion liquid 1 is prepared.

Preparation of Coating Resin Layer-Forming Dispersion Liquid 2

Similarly to coating resin layer-forming dispersion liquid 1 except that the silica particles are replaced with silica particles with a volume-average particle diameter of 80 nm of which the surface is processed by triethanolamine, coating resin layer-forming dispersion liquid 2 is prepared.

Preparation of Coating Resin Layer-Forming Dispersion Liquid 3

Toluene solution (solid concentration: 10%) of IUPILON Z300 (trade name, made by Mitsubishi Gas Chemicals Inc.): 900 parts by weight PTFE particles with a volume-average particle diameter 700 nm: 10 parts by weight The above materials are processed in the same method as coating resin layer-forming dispersion liquid 1, whereby coating resin layer-forming dispersion liquid 3 is prepared.

Preparation of Coating Resin Layer-Forming Dispersion Liquid 4

Similarly to coating resin layer-forming dispersion liquid 1 except that the silica particles are replaced with silica particles with a volume-average particle diameter of 100 nm of which the surface is processed by triethanolamine, coating resin layer-forming dispersion liquid 4 is prepared.

Preparation of Coating Resin Layer-Forming Dispersion Liquid 5

Similarly to coating resin layer-forming dispersion liquid 1 except that the silica particles are replaced with silica particles with a volume-average particle diameter of 400 nm of which the surface is processed by triethanolamine, coating resin layer-forming dispersion liquid 5 is prepared.

Preparation of Coating Resin Layer-Forming Dispersion Liquid 6

Toluene solution (solid concentration: 10%) of cyclohexylmethacrylate: 900 parts by weight PTFE particles with a volume-average particle diameter 300 nm: 10 parts by weight The above materials are processed in the same method as coating resin layer-forming dispersion liquid 1, whereby coating resin layer-forming dispersion liquid 6 is prepared.

Production of Coating Resin Layer-Forming Dispersion Liquid 7

Similarly to coating resin layer-forming dispersion liquid 3 except that the PTFE particles are replaced with melamine particles with a volume-average particle diameter of 300 nm, coating resin layer-forming dispersion liquid 7 is prepared.

Preparation of Coating Resin Layer-Forming Dispersion Liquid 8

Similarly to coating resin layer-forming dispersion liquid 3 except that the PTFE particles are replaced with silica particles with a volume-average particle diameter of 80 nm processed by the HMDS, coating resin layer-forming dispersion liquid 8 is prepared.

Preparation of Coating Resin Layer-Forming Dispersion Liquid 9

Similarly to coating resin layer-forming dispersion liquid 3 except that the PTFE particles are replaced with melamine particles with a volume-average particle diameter of 600 nm, coating resin layer-forming dispersion liquid 9 is prepared.

Preparation of Coating Resin Layer-Forming Dispersion Liquid 10

Similarly to coating resin layer-forming dispersion liquid 1 except that the particles are replaced with silica particles with a volume-average particle diameter of 50 nm of which the surface is processed by triethanolamine, coating resin layer-forming dispersion liquid 10 is prepared.

Preparation of Coating Resin Layer-Forming Dispersion Liquid 11

Similarly to coating resin layer-forming dispersion liquid 1 except that the silica particles are replaced with PTFE particles with a volume-average particle diameter of 1,000 nm, coating resin layer-forming dispersion liquid 11 is prepared.

Preparation of Coating Resin Layer-Forming Dispersion Liquid 12

Similarly to coating resin layer-forming dispersion liquid 3 except that the particles are replaced with silica particles with a volume-average particle diameter of 300 nm of which the surface is processed by triethanolamine, coating resin layer-forming dispersion liquid 12 is prepared.

Preparation of Coating Resin Layer-Forming Dispersion Liquid 13

Similarly to coating resin layer-forming dispersion liquid 1 except that the silica particles are replaced with melamine particles with a volume-average particle diameter of 300 nm, coating resin layer-forming dispersion liquid 13 is prepared.

Production of CA-A 1,000 parts by weight of a magnetic core material and 250 parts by weight of coating resin layer-forming dispersion liquid 1 are introduced into a kneader and are mixed at a room temperature for 20 minutes. Thereafter, the resultant is heated at 70° C., dried under reduced pressure, and taken out, whereby a resin-coated carrier is obtained. The obtained resin-coated carrier is sieved with a 75 μm mesh to remove coarse powders, whereby carrier CA-A is obtained.

Production of CA-B to CA-M

By using coating resin layer-forming dispersion liquids 2 to 13 instead of coating resin layer-forming dispersion liquid 1, CA-B to CA-M shown in Table 2 are obtained in the same way as producing CA-A.

Calculation of SP Value

Regarding the SP values, by using Fedors' formula and the values of ei and vi described in "Basic Theory of Adhesion, written by Imoto Minoru, Polymer Journal, Chapter 5", the solubility parameter SP1 of the resin of the coating resin layer, the solubility parameter SP2 of the organic particles (PTFE, melamine), and the solubility parameter SP3 of the organic layer (surface processing agent) on the surface of the inorganic particles (silica particles) are calculated.

TABLE 2

| | coating layer resin | | added particle in coating layer | | | | |
|---|---|---|---|---|---|---|---|
| carrier | resin type | SP1 $(cal/cm^3)^{1/2}$ at 25° C. | fine particle | processing agent | SP2 or SP3 $(cal/cm^3)^{1/2}$ at 25° C. | particle diameter (nm) | ΔSP $(cal/cm^3)^{1/2}$ at 25° C. |
| CA-A | perfluoropropylethyl methacrylate/MMA = 30/70 | 8.74 | SiO2 | trimethanol amine | 14.93 | 300 | 6.19 |
| CA-B | perfluoropropylethyl methacrylate/MMA = 30/70 | 8.74 | SiO2 | trimethanol amine | 14.93 | 80 | 6.19 |

TABLE 2-continued

| | coating layer resin | | added particle in coating layer | | | | |
|---|---|---|---|---|---|---|---|
| carrier | resin type | SP1 $(cal/cm^3)^{1/2}$ at 25° C. | fine particle | processing agent | SP2 or SP3 $(cal/cm^3)^{1/2}$ at 25° C. | particle diameter (nm) | ΔSP $(cal/cm^3)^{1/2}$ at 25° C. |
| CA-C | IUPILON PC-Z300 | 11.45 | PTFE | — | 5.83 | 700 | 5.62 |
| CA-D | perfluoropropylethyl methacrylate/MMA = 30/70 | 8.74 | SiO2 | trimethanol amine | 14.93 | 100 | 6.19 |
| CA-E | perfluoropropylethyl methacrylate/MMA = 30/70 | 8.74 | SiO2 | trimethanol amine | 14.93 | 400 | 6.19 |
| CA-F | cyclohexyl metacrylate | 10.03 | PTFE | — | 5.83 | 300 | 4.20 |
| CA-G | IUPILON PC-Z300 | 11.45 | melamine | — | 21.06 | 300 | 9.61 |
| CA-H | IUPILON PC-Z300 | 11.45 | SiO2 | HMDS | 6.87 | 80 | 4.58 |
| CA-I | IUPILON PC-Z300 | 11.45 | melamine | — | 21.06 | 600 | 9.61 |
| CA-J | perfluoropropylethyl methacrylate/MMA = 30/70 | 8.74 | SiO2 | trimethanol amine | 14.93 | 50 | 6.19 |
| CA-K | IUPILON PC-Z300 | 11.45 | PTFE | — | 5.83 | 1000 | 5.62 |
| CA-L | IUPILON PC-Z300 | 11.45 | SiO2 | trimethanol amine | 14.93 | 300 | 3.48 |
| CA-M | perfluoropropylethyl methacrylate/MMA = 30/70 | 8.74 | melamine | — | 21.06 | 300 | 12.32 |

Preparation of Developer According to Example 1

TN-A-c: 8 parts by weight

CA-A: 92 parts by weight

The above materials are introduced into the V blender and are agitated for 20 minutes to prepare a cyan developer.

A magenta developer and a yellow developer are prepared in the same way.

Preparation of Replenishing Developer According to Example 1

TN-A-c: 100 parts by weight

CA-A: 15 parts by weight

The above materials are filled in a cartridge to produce a cyan replenishing developer.

A magenta developer and a yellow developer are prepared in the same way.

Developers of Y, M, C colors with a toner concentration of 8% by weight are produced and are tested under the condition of 30° C. and 80% RH using reconstructed machine of 700 DIGITAL COLOR PRESS (trade name, made by Fuji Xerox Co., Ltd.).

As an actual machine test, 10 sheets are output with an image density of 5% for each color (Cin 100%) and an image as a reference for measuring an initial transfer efficiency and ΔE is then printed out. Then, 100,000 sheets are output with an image density of 0.5% (Cin 100%) for each color and the image for measuring the transfer efficiency and the ΔE is then printed out. Finally, 200 sheets are output with an image density of 25% (Cin 80%) for each color and the image for measuring the transfer efficiency and the ΔE is then printed out.

The measurement of the transfer efficiency and the image unevenness are performed as follows.

Transfer Efficiency: A patch of 2 cm×5 cm with Cin 80% for each of Y, M, and C colors is printed out, a tester is stopped in the state where an image is developed on the photoreceptor, and the amount of developing toner on the photoreceptor is measured (DMAy/DMAm/DMAc). Then, the same patch is printed out again, the tester is stopped before the fixing, and the amount of toner on the paper is measured (TMA).

$$\text{Transfer efficiency}=100-((DMAy+DMAm+DMAc-TMA)/(DMAy+DMAm+DMAc))\times 100$$

Evaluation of Transfer Unevenness: A patch of 5 cm×20 cm in which Y, M, and C colors are superposed with Cin 80% is printed out and a color difference (ΔE) from the initial image is evaluated with four points in the patches using COLOR DIFFERENCE MEASURER 938, trade name, made by X-rite Co., Ltd.

$$\text{Dispersion}=((\Sigma\Delta E^2)/4)^{1/2}$$

The results are shown in Tables 3 and 4. In Table 3, the trickle rate represents the mixture weight ratio (carrier/toner) of the carrier and the toner of the replenishing developer. Regarding TN-A to TN-F, for example, TN-A represents that a developer including three color toners of the Y, M, and C developers like TN-A-c, TN-A-m, and TN-A-y is used.

TABLE 3

| | carrier | added particle diameter (nm) | ΔSP $(cal/cm^3)^{1/2}$ at 25° C. | toner | average amount of Al on surface atom % | trickle rate % by weight |
|---|---|---|---|---|---|---|
| Ex. 1 | CA-A | 300 | 6.19 | TN-A | 0.006 | 15 |
| Ex. 2 | CA-A | 300 | 6.19 | TN-B | 0.003 | 15 |
| Ex. 3 | CA-A | 300 | 6.19 | TN-C | 0.017 | 15 |
| Ex. 4 | CA-B | 80 | 6.19 | TN-A | 0.006 | 15 |
| Ex. 5 | CA-C | 700 | 5.62 | TN-A | 0.006 | 15 |
| Ex. 6 | CA-D | 100 | 6.19 | TN-A | 0.006 | 15 |
| Ex. 7 | CA-E | 400 | 6.19 | TN-A | 0.006 | 15 |
| Ex. 8 | CA-F | 300 | 4.20 | TN-A | 0.006 | 15 |
| Ex. 9 | CA-G | 300 | 9.61 | TN-A | 0.006 | 15 |
| Ex. 10 | CA-H | 80 | 4.58 | TN-C | 0.017 | 15 |
| Ex. 11 | CA-I | 600 | 9.61 | TN-B | 0.003 | 15 |
| Ex. 12 | CA-A | 300 | 6.19 | TN-A | 0.006 | 5 |
| Ex. 13 | CA-A | 300 | 6.19 | TN-A | 0.006 | 0 |
| Com. Ex. 1 | CA-A | 300 | 6.19 | TN-D | 0.001 | 15 |
| Com. Ex. 2 | CA-A | 300 | 6.19 | TN-E | 0.027 | 15 |
| Com. Ex. 3 | CA-J | 50 | 6.19 | TN-A | 0.006 | 15 |
| Com. Ex. 4 | CA-K | 1000 | 5.62 | TN-A | 0.006 | 15 |
| Com. Ex. 5 | CA-L | 300 | 3.48 | TN-A | 0.006 | 15 |
| Com. Ex. 6 | CA-M | 300 | 12.32 | TN-A | 0.006 | 15 |
| Ex. 14 | CA-A | 300 | 6.19 | TN-F | 0.006 | 15 |

TABLE 4

| | carrier | initial transfer efficiency | transfer efficiency after low AC | transfer efficiency after high AC | ΔE dispersion after low image density | ΔE dispersion after high image density | comprehensive evaluation |
|---|---|---|---|---|---|---|---|
| Ex. 1 | CA-A | 95 | 90 | 88 | 2.9 | 4.5 | 13 |
| Ex. 2 | CA-A | 94 | 88 | 82 | 4.5 | 5.2 | 9 |
| Ex. 3 | CA-A | 96 | 92 | 88 | 4.4 | 5.0 | 11 |
| Ex. 4 | CA-B | 95 | 91 | 85 | 3.0 | 5.6 | 11 |
| Ex. 5 | CA-C | 94 | 89 | 82 | 3.1 | 5.38 | 9 |
| Ex. 6 | CA-D | 94 | 91 | 85 | 3.0 | 4.6 | 13 |
| Ex. 7 | CA-E | 95 | 90 | 88 | 3.0 | 5.0 | 11 |
| Ex. 8 | CA-F | 95 | 89 | 82 | 3.2 | 5.9 | 9 |
| Ex. 9 | CA-G | 94 | 89 | 85 | 3.4 | 4.8 | 11 |
| Ex. 10 | CA-H | 96 | 92 | 83 | 5.2 | 5.9 | 9 |
| Ex. 11 | CA-I | 93 | 88 | 81 | 4.9 | 6.3 | 9 |
| Ex. 12 | CA-A | 95 | 90 | 85 | 3.0 | 5.8 | 11 |
| Ex. 13 | CA-A | 95 | 90 | 82 | 3.5 | 6.5 | 11 |
| Com. Ex. 1 | CA-A | 93 | 85 | 75 | 5.1 | 5.9 | 6 |
| Com. Ex. 2 | CA-A | 97 | 93 | 79 | 5.3 | 5.9 | 8 |
| Com. Ex. 3 | CA-J | 94 | 89 | 78 | 3.8 | 9.8 | 8 |
| Com. Ex. 4 | CA-K | 95 | 89 | 73 | 4.2 | 11.8 | 8 |
| Com. Ex. 5 | CA-L | 95 | 87 | 79 | 4.3 | 8.7 | 8 |
| Com. Ex. 6 | CA-M | 94 | 88 | 80 | 4.2 | 9.2 | 8 |
| Ex. 14 | CA-A | 95 | 90 | 88 | 3.0 | 4.6 | 13 |

The comprehensive evaluation is performed as follows.

Transfer Efficiency:

| | |
|---|---|
| from 90 to 100 | 3 points |
| greater than 80 and less than 90 | 1 point |
| 80 or less | 0 point |

ΔE Unevenness:

| | |
|---|---|
| less than 5.0 | 3 points |
| equal to or greater than 5.0 and less than 12.0 | 1 point |
| 12.0 or greater | 0 point |

Here, 11 or greater points in the comprehensive evaluation is a level causing no problem in actual use, and 9 or greater points is an allowable level in actual use.

In Example 14, the transfer efficiency does not cause a problem, but clear uneven gloss which is allowable in actual use appears in the fixed image.

The foregoing description of the exemplary embodiments of the invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic developer comprising:

a toner that includes toner base particles and an external additive attached to a surface of the toner base particles, an amount of Al on the surface of the toner base particles being from about 0.002 atm % to about 0.02 atm %; and a carrier that includes magnetic particles and a coating resin layer that coats the magnetic particles, the coating resin layer including organic particles with a volume-average particle diameter of from about 80 nm to about 800 nm or inorganic particles having an organic layer on a surface of the inorganic particles with a volume-average particle diameter of from about 80 nm to about 800 nm, the carrier satisfying one of the following formulas, SP1 representing a solubility parameter of a resin of the coating resin layer, SP2 representing a solubility parameter of the organic particles, and SP3 representing a solubility parameter of the organic layer:

$$\text{about } 10 > |SP1 - SP2| > \text{about } 4 \quad (1); \text{ and}$$

$$\text{about } 10 > |SP1 - SP3| > \text{about } 4 \quad (2):$$

wherein the resin of the coating resin layer of the carrier includes at least one selected from the group consisting of fluorine resins and polycarbonates; the organic particles include at least one selected from the group consisting of polytetrafluoroethylene and melamine resins; and the organic layer includes at least one selected from the group consisting of trimethanol amine, triethanol amine, and silylation agents; wherein the coating resin layer of the carrier comprises the inorganic particles having an organic layer on a surface of the inorganic particles and wherein the organic layer includes triethanol amine.

2. The electrophotographic developer according to claim 1, wherein a volume-average particle diameter of the organic particles and the inorganic particles having the organic layer on a surface of the inorganic particles is in a range of from about 100 nm to about 400 nm.

3. The electrophotographic developer according to claim 1, wherein the organic particles include polytetrafluoroethylene.

4. The electrophotographic developer according to claim 1, wherein the resin of the coating resin layer of the carrier is obtained by polymerizing a polymerizable monomer including perfluoropropyl ethylmethacrylate.

5. The electrophotographic developer according to claim 1, wherein a weight ratio (toner:carrier) of the toner and the carrier is in a range of from about 80:20 to about 0.5:99.5.

6. The electrophotographic developer according to claim 1, wherein the toner base particles comprise a binder resin including an amorphous resin and a weight-average molecular weight (Mw) of the amorphous resin is in a range of from about 5,000 to about 1,000,000.

7. The electrophotographic developer according to claim 6, wherein a molecular weight distribution Mw/Mn of the amorphous resin is in a range of from about 1.5 to about 100.

8. The electrophotographic developer according to claim 6, wherein a glass-transition temperature of the amorphous resin is in a range of from about 35° C. to about 100° C.

9. The electrophotographic developer according to claim 6, wherein a softening point of the amorphous resin is in a range of from about 80° C. to about 130° C.

10. The electrophotographic developer according to claim 1, wherein the toner base particles include a release agent and a ratio ($\eta 2/\eta 1$) of a viscosity $\eta 1$ of the release agent at 160° C. and a viscosity $\eta 2$ of the release agent at 200° C. is in a range of from about 0.5 to about 0.7.

11. The electrophotographic developer according to claim 1, wherein a shape factor of the toner base particles is in a range of from about 115 to about 140.

12. The electrophotographic developer according to claim 1, wherein a volume-average particle diameter of the toner base particles is in a range of from about 3.5 lam to about 5.0 μm.

13. A developer cartridge that is detachably attached to an image forming apparatus and that receives the electrophotographic developer according to claim 1 and supplies the electrophotographic developer to a developing unit that develops an electrostatic latent image, formed on a photoreceptor, to form a toner image.

14. A process cartridge which detachably attached to an image forming apparatus and which includes at least one of:

a developing unit that develops an electrostatic latent image, formed on a photoreceptor, into a toner image, using the electrophotographic developer according to claim 1;

a charging unit that charges a surface of the photoreceptor;

an electrostatic latent image forming unit that forms the electrostatic latent image on the charged surface of the photoreceptor;

a transfer unit that transfers the toner image formed on the photoreceptor onto a transfer medium;

a cleaning unit that removes toner residual remaining on the surface of the photoreceptor after transferring the toner image; and a developer cartridge that supplies a replenishing developer to the developing unit.

15. An image forming apparatus comprising:

a photoreceptor;

a charging unit that charges a surface of the photoreceptor;

an electrostatic latent image forming unit that forms an electrostatic latent image on the charged surface of the photoreceptor;

a developing unit that develops the electrostatic latent image formed on the photoreceptor, into a toner image, using the electrophotographic developer according to claim 1; and a transfer unit that transfers the toner image onto a transfer medium.

16. The image forming apparatus according to claim 15, further comprising a developer cartridge that supplies a replenishing developer to the developing unit.

17. An electrophotographic developer comprising:

A toner that includes toner base particles and an external additive attached to a surface of the toner base particles, an amount of Al on the surface of the toner base particles being from about 0.002 atm % to about 0.02 atm %; and A carrier that includes magnetic particles and a coating resin layer that coats the magnetic particles, the coating resin layer including organic particles with a volume-average particle diameter of from about 80 nm to about 800 nm or inorganic particles having an organic layer on a surface of the inorganic particles with a volume-average particle diameter of from about 80 nm to about 800 nm, the carrier satisfying one of the following formulas, SP1 representing a solubility parameter of a resin of the coating resin layer, SP2 representing a solubility parameter of the organic particles, and SP3 representing a solubility parameter of the organic layer:

$$\text{about } 10 > |SP1 - SP2| > \text{about } 4 \quad (1); \text{ and}$$

$$\text{about } 10 > |SP1 - SP3| > \text{about } 4 \quad (2);$$

wherein the resin of the coating resin layer of the carrier includes at least one selected from the group consisting of fluorine resins and polycarbonate; the organic particles include at least one selected from the group consisting of polytetrafluoroethylene and melamine resins; and the organic layer includes at least one selected from the group consisting of trimethanol amine, triethanol amine, and silylation agents, and wherein the resin of the coating resin layer of the carrier is obtained by polymerizing a polymerizable monomer including perfluoropropyl ethyl methacrylate.

* * * * *